US011067931B2

(12) United States Patent
Izumi

(10) Patent No.: US 11,067,931 B2
(45) Date of Patent: Jul. 20, 2021

(54) IMAGE FORMING APPARATUS AND SYSTEM THAT REDUCE DEFECTS CAUSED BY RESIDUAL TONER

(71) Applicant: TOSHIBA TEC KABUSHIKI KAISHA, Tokyo (JP)

(72) Inventor: Takao Izumi, Yokohama Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/935,264

(22) Filed: Jul. 22, 2020

(65) Prior Publication Data

US 2021/0072690 A1 Mar. 11, 2021

Related U.S. Application Data

(63) Continuation of application No. 16/565,552, filed on Sep. 10, 2019, now Pat. No. 10,754,283.

(51) Int. Cl.
*G03G 15/08* (2006.01)
*G03G 15/00* (2006.01)

(52) U.S. Cl.
CPC ..... *G03G 15/5045* (2013.01); *G03G 15/0806* (2013.01); *G03G 15/0848* (2013.01); *G03G 15/505* (2013.01)

(58) Field of Classification Search
USPC ..... 399/44
See application file for complete search history.

(56) References Cited

U.S. PATENT DOCUMENTS

| | | | | |
|---|---|---|---|---|
| 5,475,476 | A | 12/1995 | Murai et al. | |
| 6,169,861 | B1 | 1/2001 | Hamby et al. | |
| 7,274,887 | B2 * | 9/2007 | Mo | G03G 15/5041 399/49 |
| 8,064,782 | B2 | 11/2011 | Nakazato et al. | |
| 9,025,977 | B2 | 5/2015 | Sugiyama et al. | |
| 10,156,823 | B2 | 12/2018 | Takano | |
| 2008/0175608 | A1 | 7/2008 | Kobashigawa | |
| 2008/0292343 | A1 | 11/2008 | Gomi et al. | |

(Continued)

OTHER PUBLICATIONS

Non-Final Office Action for U.S. Appl. No. 16/565,552 dated Jan. 27, 2020.

*Primary Examiner* — Q Grainger
(74) *Attorney, Agent, or Firm* — Amin, Turocy & Watson, LLP

(57) ABSTRACT

According to one embodiment, an image forming apparatus includes an image carrier, an exposing apparatus, a developing device, a transfer device, a fixing device, a history acquisition unit, an estimation unit, and an output unit. The exposing device exposes the image carrier to form an electrostatic latent image on the image carrier. The developing device includes a layer forming member to form a toner layer on a developing roller and forms a toner image by developing the electrostatic latent image. The transfer device transfers the toner image to a sheet. The fixing device fixes the toner image to the sheet. The history acquisition unit acquires a history regarding a temperature around the developing device. The estimation unit estimates a possibility that an image defect caused by the layer formation may occur on the basis of the history. The output unit outputs estimation results of the estimation.

20 Claims, 9 Drawing Sheets

(56) References Cited

U.S. PATENT DOCUMENTS

| | | | | |
|---|---|---|---|---|
| 2013/0230333 | A1* | 9/2013 | Hirobe | G03G 15/0887 399/44 |
| 2015/0277321 | A1* | 10/2015 | Nonaka | H04N 1/00631 399/82 |

* cited by examiner

FIG. 5

| DATE | NUMBER OF CUMULATIVE PRINTED SHEETS (CUMULATIVE COUNTED VALUE) | NUMBER OF CUMULATIVE DOUBLE-SIDED PRINTED SHEETS (CUMULATIVE COUNTED VALUE) | NUMBER OF PRINTED SHEETS PER DAY | TEMPERATURE OF DRUM THERMISTOR (℃) |
|---|---|---|---|---|
| 2019/6/1 | 0 | 0 | 0 | 25 |
| 2019/6/2 | 9000 | 3000 | 9000 | 33 |
| 2019/6/3 | 15000 | 6000 | 6000 | 32 |
| 2019/6/4 | 36000 | 20000 | 21000 | 35 |
| 2019/6/5 | 56000 | 28000 | 20000 | 33 |
| 2019/6/6 | 70000 | 35000 | 14000 | 37 |

FIG. 6

| ABNORMAL TEMPERATURE CONTINUOUS TIME (H) | DEGREE OF URGENCY | NOTIFICATION DETAILS |
|---|---|---|
| 0~3 | NONE | MAINTENANCE IS NOT NECESSARY. |
| 3~5 | LOW | DOUBLE-SIDED CONTINUOUS PRINTING FOR LONG PERIOD OF TIME IS PERFORMED OCCASIONALLY. PLEASE PERFORM MAINTENANCE REGULARLY. |
| 5~ | HIGH | FREQUENCY OF DOUBLE-SIDED CONTINUOUS PRINTING FOR LONG PERIOD OF TIME IS HIGH. PLEASE PERFORM MAINTENANCE FREQUENTLY. |

110

DEVELOPING DEVICE SUPPORT

| STATE | DEGREE OF URGENCY | NOTIFICATION |
|---|---|---|
| TONER STICKING | LOW | DOUBLE-SIDED CONTINUOUS PRINTING FOR LONG PERIOD OF TIME IS PERFORMED OCCASIONALLY. PLEASE PERFORM MAINTENANCE REGULARLY. |
| ... | ... | ... |

IMAGE FORMING APPARATUS AND SYSTEM THAT REDUCE DEFECTS CAUSED BY RESIDUAL TONER

CROSS-REFERENCE TO RELATED APPLICATIONS

This application is a Continuation of application Ser. No. 16/565,552 filed on Sep. 10, 2019, the entire contents of which are incorporated herein by reference.

FIELD

Embodiments described herein relate generally to an image forming apparatus, a system, and methods related thereto.

BACKGROUND

A developing device of an image forming apparatus includes a layer forming member that forms a toner to a fixed layer thickness. A toner in the developing device adheres to a photoreceptor drum to visualize an electrostatic latent image on the photoreceptor drum. The visualized electrostatic latent image is a toner image. The toner image formed on the photoreceptor drum is transferred to a sheet at a predetermined transfer position. The sheet to which the toner image is transferred is heated and pressurized using a fixing device. Thereby, the toner image is fixed to the sheet.

In a case of double-sided printing, an image forming apparatus prints one surface and then prints the other surface. Specifically, in a case of double-sided printing, an image forming apparatus first transfers a toner image to one surface of a sheet and transports the sheet to a fixing device. In addition, when the fixing of one surface is terminated, the image forming apparatus transports the sheet to a transfer position again and transfers the toner image to the other surface.

In a case of double-sided printing, the sheet heated by the fixing device is transported to a transfer position again. For this reason, when double-sided printing is successively performed, the heated sheet warms a transfer unit and a photoreceptor drum, which results in an increase in temperature inside the image forming apparatus. When the temperature inside the image forming apparatus rises, the temperature inside a developing device also rises.

When double-sided printing is successively performed, a toner is stirred inside the developing device in which the temperature rises and transported. Thereby, a toner rotation agent is easily peeled off, or a carrier coating agent is easily peeled off. For this reason, toners tend to stick together.

Thereby, toner sticking such as soft caking and hard caking may occur in a layer forming member. When a toner sticks, the layer forming member cannot form the toner to a fixed layer thickness. For example, the amount of adhering toner is reduced in a portion in which a toner cannot be formed to its original thickness, thereby forming a thin image. For this reason, an image defect such as shading unevenness occurs in the entirety of the formed image.

In addition, once a toner sticks to the layer forming member, the image defect may not be eliminated until the layer forming member is cleaned by, for example, a service man.

In the related art, it may not be possible to prevent an image defect caused by a layer thickness of a toner in advance.

DESCRIPTION OF THE DRAWINGS

FIG. 5 is a diagram showing an example of history data stored in a storage unit;

FIG. 6 is a diagram showing an example of notification data regarding estimation results of an image defect stored in the storage unit;

DETAILED DESCRIPTION

In general, according to one embodiment, an image forming apparatus includes an image carrier, an exposing apparatus, a developing device, a transfer device, a fixing device, a history acquisition unit, an estimation unit, and an output unit. The exposing device exposes the image carrier to form an electrostatic latent image on the image carrier. The developing device includes a layer forming member, forms a toner layer on a developing roller, and forms a toner image obtained by developing the electrostatic latent image. The transfer device transfers the toner image formed by the developing device to a sheet. The fixing device heats and fixes the toner image transferred to the sheet. The history acquisition unit acquires a history related to a temperature around the developing device. The estimation unit estimates a possibility that an image defect caused by the layer formation may occur, on the basis of the history related to the temperature acquired by the history acquisition unit. The output unit outputs estimation results of the estimation performed by the estimation unit.

According to another embodiment, a method for an image forming apparatus involves exposing an image carrier to form an electrostatic latent image on the image carrier; forming a toner layer on a developing roller and forming a toner image by developing the electrostatic latent image; transferring the toner image to a sheet; fixing the toner image by heating the toner image on the sheet; acquiring a history regarding a temperature around a developing device; estimating a possibility that an image defect caused by forming the toner layer occurs on a basis of the history regarding the temperature; and outputting estimation results of the estimation.

Figure 1:
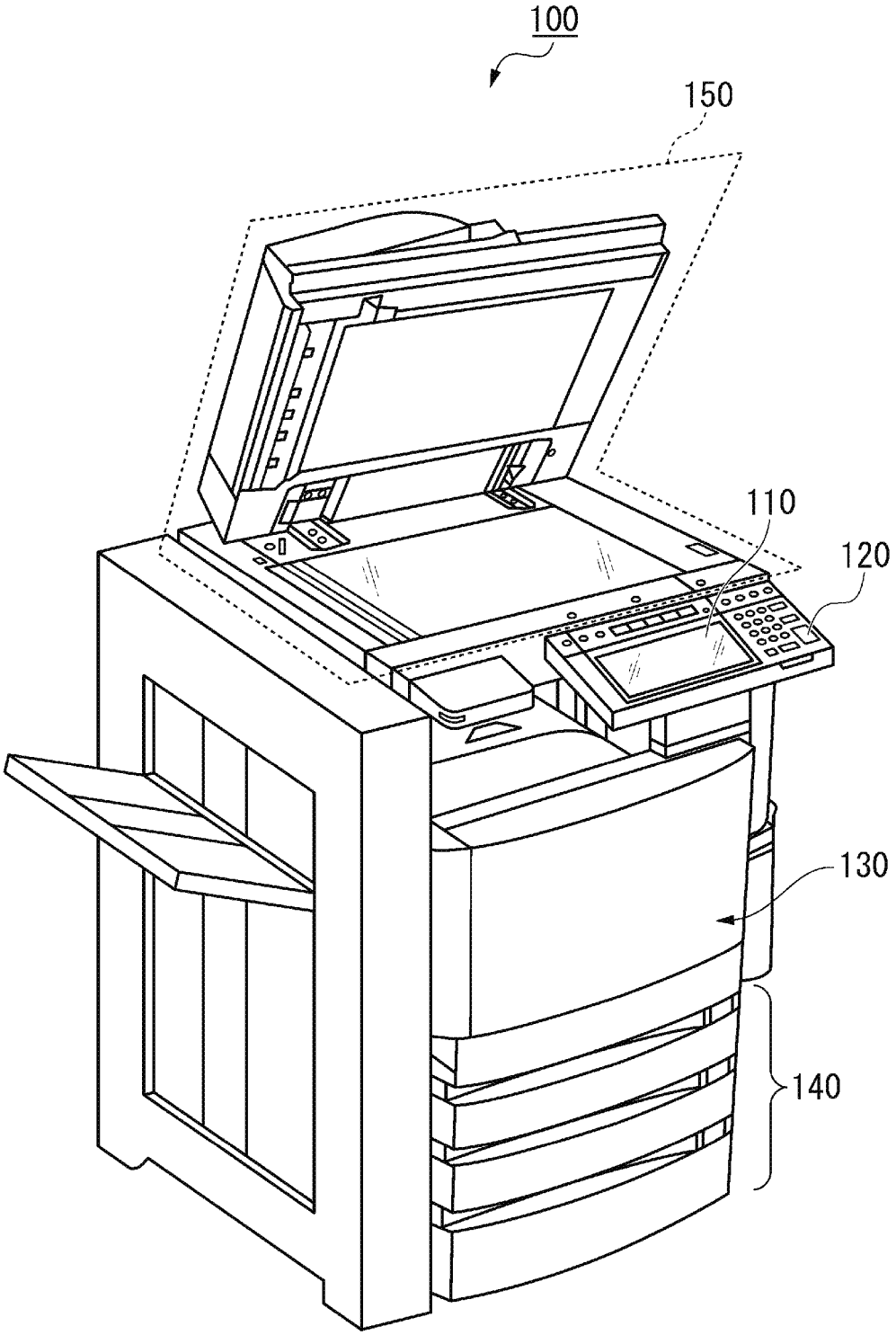
FIG. 1 is an exterior view showing an example of the overall configuration of an image forming apparatus according to an embodiment.

FIG. 1 is an exterior view showing an example of the overall configuration of an image forming apparatus 100 according to an embodiment. The image forming apparatus 100 is, for example, a multi-function printer. The image forming apparatus 100 includes a display 110, a control panel 120, a printer 130, a sheet accommodation unit 140, and an image reading unit 150.

The display 110 is, for example, a liquid crystal display with a touch panel. The display 110 displays various pieces of information. In addition, the display 110 receives a user's operation. The display 110 displays various operation screens, the state of an image, an operation state of each function, and the like in response to a display control signal output from a control unit.

The control panel 120 includes various operation keys such as a numeric keypad and a start key. The control panel 120 receives various input operations from a user. In addition, the control panel 120 outputs operation signals based on various input operations received from the user to the control unit.

The printer 130 performs a series of printing operations using various information output from the display 110, the control panel 120, the image reading unit 150 and the like. The series of printing operations include an operation of inputting image information, an operation of forming an image, an operation of transferring the formed image to a sheet, an operation of transporting the sheet, and the like.

The sheet accommodation unit 140 includes a plurality of sheet cassettes. Each of the sheet cassettes accommodates sheets.

The image reading unit 150 includes an automatic manuscript feeding apparatus and a scanner apparatus. The automatic manuscript feeding apparatus sends out a manuscript placed on a manuscript tray to the scanner apparatus. The scanner apparatus optically performs scanning of the manuscript on a manuscript glass base to image light reflected from the manuscript on a light receiving surface of a charge coupled device (CCD) sensor. Thereby, the scanner apparatus reads a manuscript image on the manuscript glass base. The image reading unit 150 generates image information (image data) using results of reading of the scanner apparatus.

Figure 2:
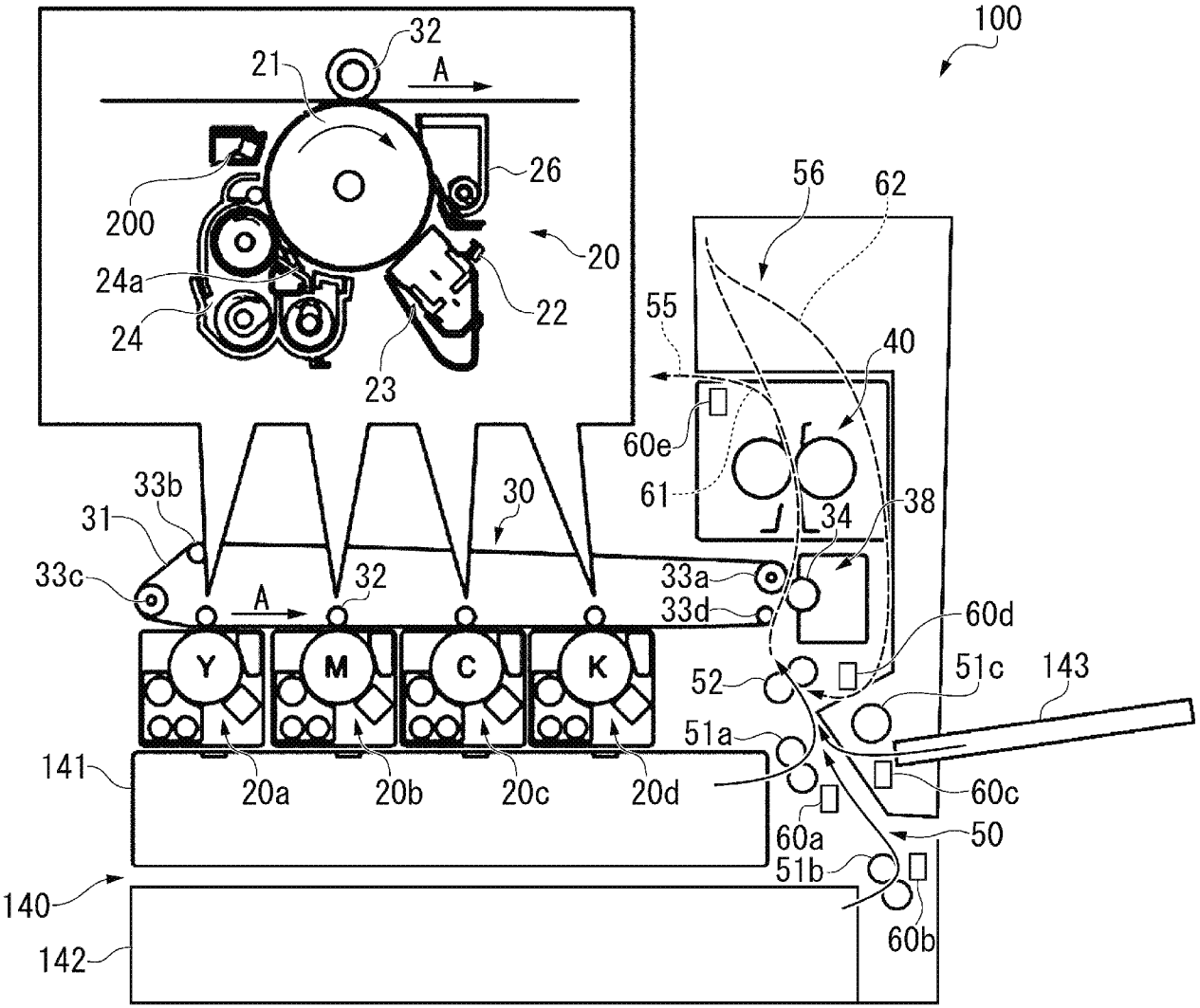
FIG. 2 is a diagram showing an example of an internal configuration of the image forming apparatus.

FIG. 2 is a diagram showing an example of an internal configuration of the image forming apparatus 100. As shown in FIG. 2, the image forming apparatus 100 (printer 130) includes four image forming units 20*a* to 20*d* in parallel. The image forming apparatus 100 is a so-called quadruple tandem type image forming apparatus.

The image forming apparatus 100 includes an image processing unit not shown in the drawing, an image forming unit 20, an intermediate transfer unit 30, a fixing device 40, and a sheet transport unit 50.

The image processing unit inputs image information. The input image information is image information generated by the image reading unit 150 or image information transmitted from other apparatuses. The image processing unit performs digital image processing for processing the input image information in accordance with initial setting or a user's setting. For example, the digital image processing includes gradation correction based on gradation correction data. Further, in addition to the gradation correction, the digital image processing includes various correction processing such as color correction and shading correction and processing such as compression which are performed on input image data.

Next, the image forming unit 20 (image forming units 20*a* to 20*d*) will be described. The image forming unit 20 includes an image forming unit 20*a* corresponding to Y (yellow), an image forming unit 20*b* corresponding to M (magenta), an image forming unit 20*c* corresponding to C (cyan), and an image forming unit 20*d* corresponding to K (black). Each of the image forming units 20*a* to 20*d* include a photoreceptor drum 21, a charging device 22, an exposing apparatus 23, a developing device 24, a drum cleaning apparatus 26, a drum thermistor 200 and the like. Hereinafter, description will be given by referring the image forming units 20*a* to 20*d* to as an image forming unit 20.

The photoreceptor drum 21 is, for example, a charged organic photoconductor (OPC) in which an undercoat layer, a charge generating layer and a charge transport layer are sequentially laminated on the peripheral surface of an aluminum conductive cylindrical body.

The charging device 22 causes corona discharge. The charging device 22 uniformly charges the surface of the photoreceptor drum 21.

The exposing apparatus 23 is, for example, a semiconductor laser. The exposing apparatus 23 irradiates the photoreceptor drum 21 with a laser beam corresponding to an image of each color component. When a laser beam is emitted by the exposing apparatus 23, a potential of a region irradiated with the laser beam in a region of the surface of the photoreceptor drum 21 changes. An electrostatic latent image is formed on the surface of the photoreceptor drum 21 due to the change in potential (potential difference).

The developing device 24 accommodates a developer. The developing device includes a layer forming member 24*a*. The layer forming member 24*a* forms a toner layer having a fixed layer thickness. The developing device 24 attaches a toner of each color component to the surface of the photoreceptor drum 21. Thereby, a toner image is formed on the photoreceptor drum 21. That is, the electrostatic latent image formed on the surface of the photoreceptor drum 21 is visualized.

Here, the developer will be described. A two-component developer is used for the developer. The two-component developer includes a non-magnetic toner and a carrier. For example, iron powder having a particle diameter of several tens of μm or polymer ferrite particles are used for the carrier. The carrier is mixed with a toner inside the developing device 24 and is frictionally charged to impart a charge (for example, a negative charge) to the toner. In addition, the carrier transports the toner to the electrostatic latent image portion using magnetism. However, the developer is not limited to the two-component developer, and a one-component developer not using a carrier can also be used.

The drum cleaning apparatus 26 includes a cleaning blade which is in contact with the surface of the photoreceptor drum 21. The cleaning blade removes a residual toner remaining on the surface of the photoreceptor drum 21 after primary transfer. The removed residual toner is accommodated in an accommodation unit included in the drum cleaning apparatus 26.

The drum thermistor 200 detects a surface temperature of the photoreceptor drum 21. Results of the detection of the surface temperature are used for the control of a charging bias and the like. Meanwhile, the drum thermistor 200 is not necessarily disposed at a position shown in the drawing and may be disposed at any position as long as the surface temperature of the photoreceptor drum 21 can be detected.

Next, the intermediate transfer unit 30 will be described. The intermediate transfer unit 30 includes an intermediate transfer body 31, a primary transfer roller 32, a plurality of supporting rollers 33, a secondary transfer roller 34, a belt cleaning apparatus not shown in the drawing, and the like.

The intermediate transfer body 31 is, for example, an endless belt. The intermediate transfer body 31 has conductivity and elasticity.

Supporting rollers 33*a* to 33*d* support the intermediate transfer body 31 so that tension is applied to the intermediate transfer body 31. Thereby, the intermediate transfer body 31 is formed in a loop shape. Among the plurality of supporting rollers 33*a* to 33*d*, anyone roller (for example, the supporting roller 33*a*) is a driving roller. The rollers other than the driving roller are driven rollers. The driving roller is driven, so that the intermediate transfer body 31 travels at a predetermined speed in an A-direction.

Here, a direction in which the intermediate transfer body 31 moves can be defined as an upstream direction and a downstream direction. Specifically, a direction in which the intermediate transfer body 31 moves can be defined by setting the image forming unit 20*a* to be the most upstream side and setting the belt cleaning apparatus 35 to be the most downstream side.

The primary transfer roller 32 is disposed so as to facing the photoreceptor drum 21 through the intermediate transfer body 31. Specifically, the primary transfer roller 32 is disposed such that pressure is applied to the photoreceptor drum 21 with the intermediate transfer body 31 interposed therebetween. Thus, a primary transfer unit nipping the intermediate transfer body 31 using the primary transfer roller 32 and the photoreceptor drum 21 is formed.

When the intermediate transfer body 31 passes through the primary transfer unit, a toner image formed on the photoreceptor drum 21 is transferred onto the intermediate transfer body 31. When the intermediate transfer body 31 passes through the primary transfer unit, a primary transfer bias is applied to the primary transfer roller 32. Specifically, a charge having a polarity (positive polarity) opposite to that of a toner is imparted to the primary transfer roller 32. Thereby, the toner image formed on the photoreceptor drum 21 is electrostatically transferred to the intermediate transfer belt 421.

The secondary transfer roller 34 is disposed so as to face the supporting roller 33*a* through the intermediate transfer body 31. Specifically, the secondary transfer roller 34 is disposed such that pressure is applied to the supporting roller 33*a* with the intermediate transfer body 31 interposed therebetween.

Thereby, a secondary transfer unit 38 nipping the intermediate transfer body 31 and a sheet using the secondary transfer roller 34 and the supporting roller 33*a* is formed.

When the sheet passes through the secondary transfer unit 38, the toner image on the intermediate transfer body 31 is transferred onto the sheet. When the sheet passes through the secondary transfer unit 38, a secondary transfer bias is applied to the supporting roller 33*a*. Specifically, a charge having the same polarity (negative polarity) is imparted to the supporting roller 33*a*.

Thereby, the toner image on the intermediate transfer body 31 is electrostatically transferred to the sheet. Meanwhile, the secondary transfer roller 34 and the supporting roller 33*a* are configured so as to be separable from each other. Thereby, when the secondary transfer unit 38 is clogged with the sheet, a user can remove the sheet.

The belt cleaning apparatus includes a cleaning blade which is in contact with the surface of the intermediate transfer body 31. The cleaning blade removes a residual toner remaining on the surface of the intermediate transfer body 31 after secondary transfer. The removed residual toner is collected in an accommodation unit included in the belt cleaning apparatus.

The fixing device 40 heats and pressurizes the sheet to which the toner image is transferred. Thereby, the fixing device 40 fixes the toner image to the sheet. Meanwhile, a method of fixing the toner image to the sheet by heating the sheet through a film-like member can also be applied to the fixing device 40.

Next, the sheet transport unit 50 will be described. The sheet transport unit 50 includes a paper feeding unit 51, a resist portion 52, a first guide portion not shown in the drawing, a second guide portion not shown in the drawing, a paper discharge unit 55, an automatic double-sided apparatus 56, and a sheet counter 60.

Paper feeding units 51*a* to 51*c* transport sheets accommodated in the sheet accommodation unit 140 to the resist portion 52 one by one. Specifically, the paper feeding unit 51*a* transports sheets in the sheet cassette 141 to the resist portion 52 one by one. The paper feeding unit 51*b* transports sheets in the sheet cassette 142 to the resist portion 52 one by one. The paper feeding unit 51*c* transports sheets on the hand insertion tray 143 to the resist portion 52 one by one.

The resist portion 52 stops a sheet transported from the paper feeding unit 51 and sends out the sheet to the secondary transfer unit 38 at a predetermined timing. The predetermined timing is a timing when a toner image formed on the intermediate transfer body 31 is secondarily transferred.

The first guide portion regulates a transport direction of a sheet sent out from the resist portion 52 and sends out the sheet to the secondary transfer unit 38. When a toner image is transferred to the sheet regulated by the first guide portion, the secondary transfer unit 38 sends out the sheet to the fixing device 40.

In a case of single-sided printing, the fixing device 40 heats and pressurizes the sheet sent out from the secondary transfer unit 38 and sends out the sheet to the paper discharge unit 55. The second guide portion regulates a transport direction of the sheet sent out from the fixing device 40 to the paper discharge unit 55. The paper discharge unit 55 sends out the sheet to a discharge tray.

The automatic double-sided apparatus 56 includes a mechanism switching for switching a transport direction of a sheet during double-sided printing. In a case of double-sided printing, the fixing device 40 heats and pressurizes a sheet sent out from the secondary transfer unit 38 to the automatic double-sided apparatus 56. The automatic double-sided apparatus 56 switches back the sheet sent out from the fixing device 40 and sends out the sheet to the resist portion 52. The sent-out sheet reaches the resist portion 52 so that the surface opposite to the surface of the sheet when the sheet passes through the resist portion 52 for the first time faces the supporting roller 33*a* side.

The resist portion 52 stops the sheet transported from the automatic double-sided apparatus 56 and sends out the sheet to the secondary transfer unit 38 at a predetermined timing. Thereafter, similarly to the case of single-sided printing, the sheet is discharged from the paper discharge unit 55 through the secondary transfer unit 38 and the fixing device 40.

Sheet counters 60*a* to 60*e* count the number of times a sheet passes. The sheet counter 60*a* counts the number of times a sheet is sent out from the paper feeding unit 51*a*. The sheet counter 60*b* counts the number of times a sheet is sent out from the paper feeding unit 51*b*. The sheet counter 60*c* counts the number of times a sheet is sent out from the paper feeding unit 51*c*. The sheet counter 60*d* counts the number of times a sheet is sent out from the automatic double-sided apparatus 56. The sheet counter 60*e* counts the number of times a sheet is discharged from the paper discharge unit 55.

Here, when the temperature of the layer forming member 24*a* rises, a toner sticks to the layer forming member 24*a*, which results in a concern that an image defect may occur.

For this reason, in the present embodiment, the image forming apparatus 100 estimates whether or not use such as sticking of a toner to the layer forming member 24*a* is performed.

The image forming apparatus 100 of the present embodiment is not provided with a sensor or the like directly detecting the temperature of the layer forming member 24*a*. For this reason, the image forming apparatus 100 predicts the temperature of the layer forming member 24*a* using the surface temperature of the photoreceptor drum 21.

A correlation between the temperature of the layer forming member 24*a* and the surface temperature of the photoreceptor drum 21 during double-sided printing will be described using FIG. 3. The correlation is obtained through an experiment.

Figure 3:
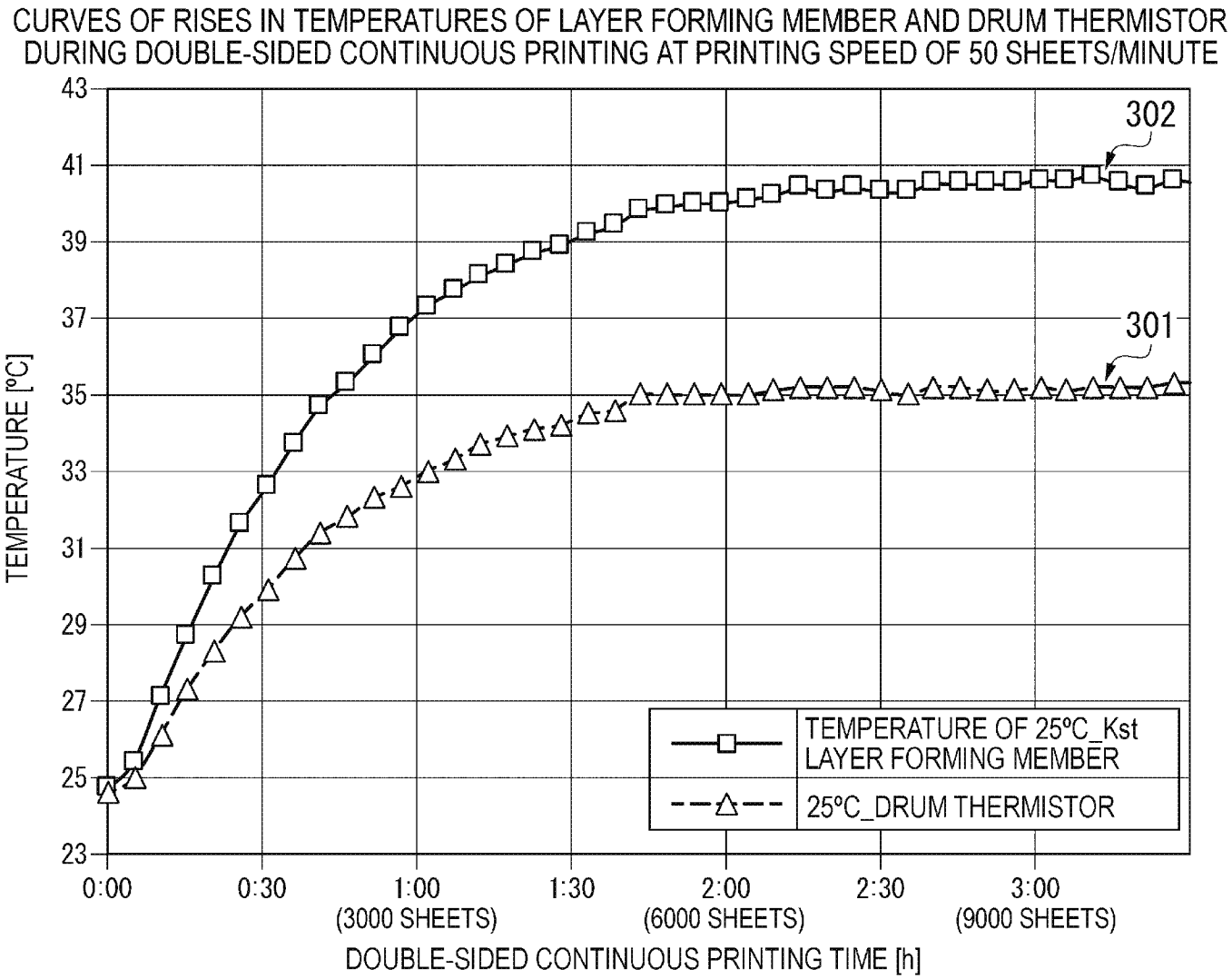
FIG. 3 is a diagram showing an example of a relationship between temperatures of a layer forming member and a drum thermistor and a double-sided continuous printing time.

FIG. 3 is a diagram showing an example of a relationship between temperatures of the layer forming member 24*a* and the drum thermistor 200 and a double-sided continuous printing time. In FIG. 3, a horizontal axis represents a time (h) for which double-sided printing is continuously performed. Meanwhile, the continuous printing means that, for example, a plurality of sheets is continuously printed without being in a standby state where printing is not performed. Hereinafter, double-sided printing being performed in a continuous printing mode may be referred to as "double-sided continuous printing".

A vertical axis represents a temperature (° C.).

A plot Δ represents the surface temperature of the photoreceptor drum 21 which is detected by the drum thermistor 200. A plot □ represents the temperature of the layer forming member 24*a*. An environmental temperature during an experiment is 25° C. In addition, a printing speed when double-sided continuous printing is performed is 50 sheets per minute. When a unit is converted into one hour, a printing speed is 3000 sheets/h.

As shown in FIG. 3, a temperature curve 301 of the photoreceptor drum 21 and a temperature curve 302 of the layer forming member 24*a* are curves drawn as similar curves. Specifically, the temperature curves 301 and 302 show a relatively sharp rise during a printing time of zero to one hour. In addition, the temperature curves 301 and 302 show a relatively slow rising curve during a printing time of one to two hours. In addition, the temperature curves 301 and 302 show a substantially saturated state after 2 hours of a printing time.

In the saturated state, the temperature curve 301 and the temperature curve 302 differ from each other by approximately 5° C. to 6° C. That is, in the saturated state, the surface temperature of the photoreceptor drum 21 is lower than the temperature of the layer forming member 24*a* by 5° C. to 6° C. For this reason, in the saturated state, a temperature obtained by adding a temperature of 5° C. to 6° C. to the surface temperature of the photoreceptor drum 21 can be set as a predicted temperature of the layer forming member 24*a*.

Here, a condition that a toner sticks to the layer forming member 24*a* is that the temperature of the layer forming member 24*a* is maintained at a predetermined temperature for a predetermined period. Specifically, a condition that a toner sticks to the layer forming member 24*a* is, for example, a condition that the temperature of the layer forming member 24*a* is maintained at 41° C. for three hours. When this condition is replaced with the surface temperature of the photoreceptor drum 21, the condition is a condition that the surface temperature of the photoreceptor drum 21 is maintained at 35° C. for three hours. Therefore, at an environmental temperature of 25° C., there is a possibility that a toner sticks to the layer forming member 24*a* when the surface temperature of the photoreceptor drum 21 is maintained at 35° C. for three hours.

Meanwhile, it is empirically known that a threshold value of a time resulting in a concern that a toner sticks to the layer forming member 24*a* changes depending on the temperature of the layer forming member 24*a*. For example, when the temperature of the layer forming member 24*a* is 43° C., a threshold value of a time is two hours. That is, when the condition is replaced with the surface temperature of the photoreceptor drum 21, a threshold value of a time is two hours when the surface temperature of the photoreceptor drum 21 is 37° C.

In addition, when an environmental temperature changes, the temperature curves 301 and 302 are also shifted in the vertical axis direction by the changed temperature. For example, the temperature curves when an environmental temperature is 2° C. higher than 25° C. (in a case of 27° C.) are curves obtained by shifting the temperature curves 301 and 302 in the vertical axis direction by +2° C., respectively.

Figure 4:
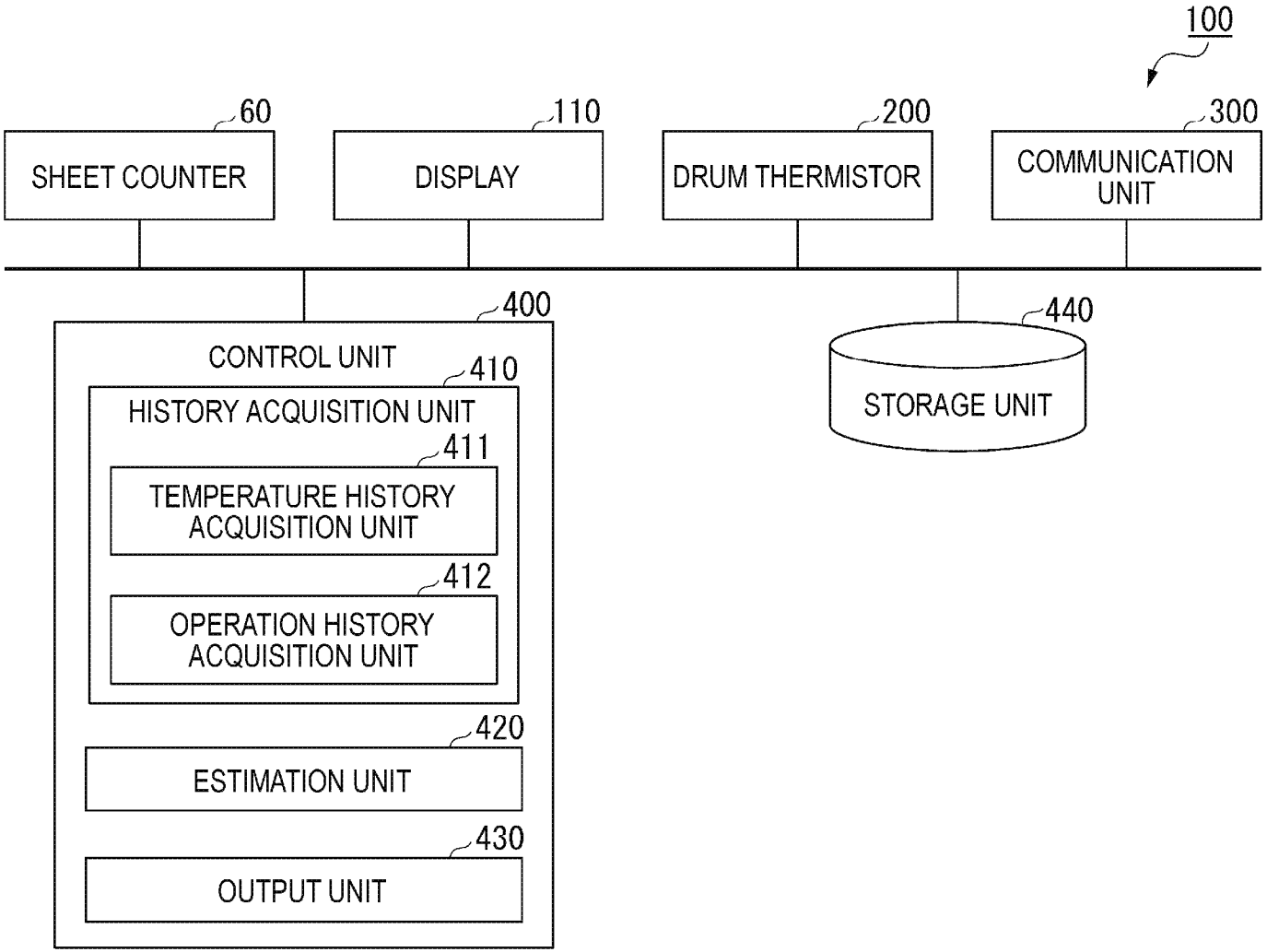
FIG. 4 is a diagram showing an example of a functional configuration of the image forming apparatus.

FIG. 4 is a diagram showing an example of a functional configuration of the image forming apparatus 100. As shown in FIG. 4, the image forming apparatus 100 includes a sheet counter 60, a drum thermistor 200, a communication unit 300, a control unit 400, and a storage unit 440.

The communication unit 300 is an interface of a network. The communication unit 300 is connected to a network through a communication line. The communication unit 300 is connected to another information processing apparatus (for example, a personal computer, a smartphone, or the like) through the network. The communication unit 300 receives image information to be printed from, for example, another information processing apparatus.

The control unit 400 includes a history acquisition unit 410, an estimation unit 420, and an output unit 430. The history acquisition unit 410 includes a temperature history acquisition unit 411 and an operation history acquisition unit 412. The control unit 400 is realized by a processor. The control unit 400 functions as the history acquisition unit 410, the temperature history acquisition unit 411, the operation history acquisition unit 412, the estimation unit 420, and the output unit 430 by executing a program by a processor.

The storage unit 440 is realized by a magnetic hard disk device or a storage device such as a semiconductor storage device. The storage unit 440 stores a history regarding the temperature of the layer forming member 24*a* and a history regarding the operation of double-sided printing (double-sided continuous printing) performed continuously. In addition, the storage unit 440 also stores details forgiving notice of estimation results of an image defect, and the like.

Here, when the developing device 24 is continuously operated in a state where the temperature of the layer forming member 24*a* is increased, a toner sticks to the layer forming member 24*a*, thereby resulting in shading unevenness of an image. An image defect caused by layer formation is an image defect caused by a toner sticking to the layer forming member 24*a*. In the following description, an "image defect caused by layer formation" may be simply referred to as an "image defect".

The history acquisition unit 410 acquires a history regarding a temperature around the developing device 24. The history regarding a temperature around the developing device 24 is a history regarding the temperature of the layer forming member 24*a* or a history regarding the operation of double-sided continuous printing. The history acquisition unit 410 acquires a history regarding a temperature around the developing device 24 with reference to the storage unit 440.

The estimation unit 420 estimates a possibility that an image defect caused by layer formation of the layer forming member 24*a* on the basis of the history regarding a temperature around the developing device 24 which is acquired by the history acquisition unit 410.

The output unit 430 outputs results of the estimation performed by the estimation unit 420.

Here, conditions that an image defect occurs include a "temperature condition" of the layer forming member 24*a* and a "condition of a double-sided printing operation". First, the "temperature condition" will be described. Meanwhile, hereinafter, for convenience of description, the description will be given on the assumption that an environmental temperature is 25° C.

The image forming apparatus 100 does not include a sensor that directly detects a temperature inside the developing device 24. As shown in FIG. 3, the temperature of the layer forming member 24*a* and the surface temperature of the photoreceptor drum 21 are related to each other. For this reason, the estimation unit 420 can estimate the temperature of the layer forming member 24*a* using the surface temperature of the photoreceptor drum 21. That is, the condition of the temperature of the layer forming member 24*a* can be the condition of the surface temperature of the photoreceptor drum 21.

The condition of the surface temperature of the photoreceptor drum 21 which is a condition that an image defect occurs is, for example, a condition that the surface temperature of the photoreceptor drum 21 is equal to or higher than 35° C.

The storage unit 440 stores a history of the temperature of the drum thermistor 200.

The temperature history acquisition unit 411 acquires a history regarding the temperature of the layer forming member 24*a*. Specifically, the temperature history acquisition unit 411 acquires the temperature of the drum thermistor 200 which is stored in the storage unit 440 as a history of the surface temperature of the photoreceptor drum 21.

Meanwhile, the image forming apparatus 100 may include a sensor that directly detects a temperature inside the developing device 24. In addition, the image forming apparatus 100 may include a sensor that directly detects the temperature of the layer forming member 24*a*. In a case where the image forming apparatus includes any one sensor out of the sensors, the temperature history acquisition unit 411 may acquire a history of a temperature detected by the sensor.

Next, the "condition of a double-sided printing operation" will be described. Hereinafter, for convenience of description, the description will be given on the assumption that an environmental temperature is 25° C. The condition of a double-sided printing operation is a condition that double-sided continuous printing is continuously performed for three hours or more.

The operation history acquisition unit 412 acquires a history regarding the operation of double-sided continuous printing. The history regarding the operation includes counted values measured by the sheet counters 60 (60*a* to 60*e*).

In addition, the history regarding the operation includes information regarding a time for which double-sided continuous printing is performed (hereinafter, may be referred to as a "double-sided continuous printing time"). The time for which double-sided continuous printing is performed is caused by a printing speed of double-sided printing. For this reason, the history regarding the operation includes information regarding a printing speed of double-sided printing.

The image forming apparatus 100 may or may not have a function of storing a job history of printing in the storage unit 440. The job history is a history of printing stored whenever printing is performed. Specifically, the job history includes information such as a date and time, the number of sheets obtained through double-sided continuous printing, a type of printing such as single-sided printing or double-sided printing, a type of printing such as color printing or monochrome printing, a sheet size, and printed image data.

When the image forming apparatus 100 has a function of storing a job history, the image forming apparatus may acquire information of a double-sided continuous printing time from the job history.

On the other hand, when the image forming apparatus 100 does not have a function of storing a job history, the image forming apparatus 100 calculates a time when double-sided continuous printing is expected to be performed (hereinafter, may be referred to as an "alternative characteristic value"). Hereinafter, the calculation of an alternative characteristic value will be described.

The alternative characteristic value is a calculated value which is calculated on the basis of a degree to which double-sided printing is performed within a predetermined period, a total number of printed sheets obtained for a period of time different from the predetermined period, and a printing speed. The degree to which double-sided printing is performed is a ratio at which double-sided printing was performed in the past (hereinafter, may be referred to as a "double-sided ratio").

The predetermined period is a period of time in which it is possible to ascertain an average use state in which double-sided printing is performed so far. For example, the predetermined period may be set to be a fixed period of time such as one month or two months. In addition, the predetermined period may be a total period of time from the time when the image forming apparatus 100 is used until now. In addition, the predetermined period may be set to be an unfixed period of time in which maintenance is performed this time after a service man performed maintenance last time.

The double-sided ratio is a value calculated from a total number of printed sheets and the number of printed sheets obtained through double-sided printing. The total number of printed sheets is the sum of the number of printed sheets obtained through single-sided printing and the number of printed sheets obtained through double-sided printing. The number of printed sheets obtained through single-sided printing and the number of printed sheets obtained through double-sided printing are acquired using values measured by the sheet counters 60 (60*a* to 60*e*).

The double-sided ratio is a ratio of the number of printed sheets obtained through double-sided printing to the total number of printed sheets. As an example, when the total number of printed sheets is set to 6000 and the number of sheets obtained through double-sided printing is set to 3000, a double-sided ratio is 1/2 (3000 sheets/6000 sheets). Meanwhile, the double-sided ratio is calculated by the control unit 400.

The period of time different from the predetermined period is, for example, a period of time shorter than the predetermined period. The period of time different from the predetermined period is, for example, one day. The total number of printed sheets is, for example, a total number of printed sheets on the day when a total number of printed sheets is the largest (hereinafter may be referred to as a "maximum number of printed sheets") among a plurality of days when printing is performed.

The printing speed is a time required for performing double-sided printing once. The alternative characteristic value is calculated on the basis of the double-sided ratio, the maximum number of printed sheets, and the printing speed. Specifically, the alternative characteristic value is calculated on the basis of "(a maximum number of printed sheets×a double-sided ratio)/a printing speed". Here, (a maximum number of printed sheets×a double-sided ratio) which is a numerator is a maximum number of sheets which is expected on the assumption that every double-sided printing per day is performed through continuous printing. A time required for printing the number of sheets (=an alternative characteristic value) is obtained by dividing the number of sheets by the printing speed.

The estimation unit 420 estimates a possibility that an image defect occurs on the basis of a history of the surface temperature of the photoreceptor drum 21 and information of a double-sided continuous printing time. The alternative characteristic value is equivalent to a time expected when it is assumed that every double-sided printing per day is performed through continuous printing. For this reason, the alternative characteristic value may deviate from a time when the double-sided continuous printing is actually performed.

In addition, such a deviation may also occur in the "temperature condition". Specifically, the surface temperature of the photoreceptor drum 21 may rise due to another factor such as a heater for preventing condensation, in addition to double-sided continuous printing. For this reason, even when the temperature of the layer forming member 24*a* does not actually rise, the surface temperature of the photoreceptor drum 21 may be detected at a high temperature. Meanwhile, the heater for preventing condensation is a heater for preventing the occurrence of condensation when an environmental temperature is low such as in a winter season.

For this reason, the estimation unit 420 may estimate that an image defect occurs even though a use state where an image defect actually occurs is not set. Consequently, in the present embodiment, the estimation unit 420 estimates that there is a possibility that an image defect may occur when both the "temperature condition" and the "condition of a double-sided printing operation" are satisfied. Specifically, the estimation unit 420 estimates that there is a possibility that an image defect may occur when the surface temperature of the photoreceptor drum 21 is equal to or higher than a predetermined temperature and an alternative characteristic value is equal to or greater than a threshold value. More specifically, estimation unit 420 estimates that there is a possibility that an image defect may occur when the surface temperature of the photoreceptor drum 21 is equal to or higher than 35° C. and an alternative characteristic value is equal to or greater than three hours.

Thereby, for example, the alternative characteristic value is a value indicating that double-sided continuous printing is performed, but the surface temperature of the photoreceptor drum 21 may be low. In this case, the estimation unit 420 can estimate that double-sided continuous printing is not actually performed. For this reason, the estimation unit 420 can estimate that there is a low possibility that an image defect may occur.

In addition, even when the surface temperature of the photoreceptor drum 21 is high, an alternative characteristic value may not be a value indicating that double-sided continuous printing is performed. In this case, the estimation unit 420 can estimate that the surface temperature of the photoreceptor drum 21 rises due to a factor other than double-sided continuous printing. For this reason, the estimation unit 420 can estimate that there is a low possibility that an image defect may occur.

In addition, a threshold value used for the estimation of the estimation unit 420 is a value varying depending on the surface temperature of the photoreceptor drum 21. For example, the threshold value is a value decreasing as the surface temperature of the photoreceptor drum 21 becomes higher. Specifically, when the threshold value is three hours when the surface temperature of the photoreceptor drum 21 is 35° C. For example, the threshold value is two hours when the surface temperature of the photoreceptor drum 21 is 37° C.

Meanwhile, the surface temperature of the photoreceptor drum 21 depends on an environmental temperature. Specifically, when an environmental temperature is high, there is a tendency for the surface temperature of the photoreceptor drum 21 to become higher than when an environmental temperature is low. For this reason, the threshold value also depends on an environmental temperature. Specifically, the threshold value is a value decreasing as an environmental temperature becomes higher.

The output unit 430 outputs results of estimation performed by the estimation unit 420 to the display 110 displaying an image. The display 110 displays the estimation results. In addition, the output unit 430 may output the estimation results to a sound output unit such as a microphone. The sound output unit may output the estimation results using a sound.

In addition, the output unit 430 displays the estimation results on the display 110 in a display mode based on a possibility that an image defect may occur. Specifically, a display mode when there is a high possibility that an image defect may occur and a display mode when there is a low possibility that an image defect may occur are different from each other. The display mode when there is a high possibility that an image defect may occur is a more conspicuous display mode than the display mode when there is a low possibility that an image defect may occur.

FIG. 5 is a diagram showing an example of history data stored in the storage unit 440. The history data shown in FIG. 5 is data including items of a date, a total number of cumulative printed sheets, the number of cumulative sheets obtained through double-sided printing, the number of printed sheets per day, and a maximum temperature of the drum thermistor 200.

The total number of cumulative printed sheets is the sum of counted values indicating the number of sheets obtained through single-sided printing and double-sided printing. Specifically, the total number of cumulative printed sheets is the sum of counted values detected by the sheet counters 60*a* to 60*c* (see FIG. 2). The total number of cumulative printed sheets may be added at any time whenever printing is performed.

The number of cumulative sheets obtained through double-sided printing is the sum of counted values indicating the number of sheets obtained through double-sided printing. Specifically, the number of cumulative sheets obtained through double-sided printing is the sum of counted values detected by the sheet counter 60*d*. The number of cumulative sheets obtained through double-sided printing is added at any time whenever double-sided printing is performed.

The number of printed sheets per day is the sum of the number of sheets obtained through single-sided printing and double-sided printing which are performed on one day. Specifically, the number of printed sheets per day is the sum of counted values detected by the sheet counters 60*a* to 60*c* (see FIG. 2) on one day. The number of printed sheets per day is a value calculated by subtracting the number of printed sheets of the previous day from the sum of the number of printed sheets of the day.

The temperature of the drum thermistor 200 is a maximum temperature among the temperatures detected by the drum thermistor 200 in one day. Meanwhile, the temperature of the drum thermistor 200 may be set to be an average temperature in a period of time in which the temperature is equal to or higher than a predetermined temperature (for example, 35° C.) at which there is a possibility that a toner may stick to the layer forming member 24*a*.

For example, 2019 Jun. 1 indicates the day when the image forming apparatus 100 is set. In history data of 2019 Jun. 1, each number of sheets is "0". That is, printing is not performed on 2019 Jun. 1.

For example, in history data of 2019 Jun. 2, a total number of cumulative printed sheets and the number of printed sheets per day are 9000, the number of cumulative sheets obtained through double-sided printing is 3000, and a temperature of the drum thermistor 200 is 25° C.

In history data of 2019 Jun. 6, a total number of cumulative printed sheets is 70000 sheets, the number of cumulative sheets obtained through double-sided printing is 35000 sheets, the number of printed sheets per day is 14000 sheets, and a temperature of the drum thermistor 200 is 37° C.

Next, the calculation of an alternative characteristic value will be described.

A double-sided ratio from 2019 Jun. 1 to 2019 Jun. 6 is 50% (35000 sheets/70000 sheets). The double-sided ratio being 50% means that double-sided printing statistically means that a user using the image forming apparatus 100 performs double-sided printing at a ratio of 50%. Regarding the number of printed sheets per day, 21000 of 2019 Jun. 4 is the maximum. The number of printed sheets per day having a maximum number of printed sheets is a maximum number of printed sheets.

The number of sheets in which double-sided printing is likely to be performed on one day of 2019 Jun. 4 is 10500 sheets (21000 sheets (a maximum number of printed sheets)×50% (a double-sided ratio)). A printing speed in the double-sided printing of the image forming apparatus 100 is 3000 sheets/h.

It is assumed that all of the 10500 sheets are continuously printed.

A time for which double-sided continuous printing is regarded as being performed is calculated by dividing the number of sheets in which double-sided printing is likely to be performed by a printing speed. That is, a time for which it is considered that double-sided continuous printing is performed (an alternative characteristic value) is 3.5 hours ("10500 sheets"/"3000 sheets/h"). In addition, the temperature of the drum thermistor 200 on a day when the printing of a maximum number of printed sheets is performed (2019 Jun. 4) is 35° C.

For this reason, the surface temperature of the photoreceptor drum 21 being set to 35° C. on 2019 Jun. 4 is regarded as being caused by double-sided continuous printing being performed for 3.5 hours. A condition that a toner sticks to the layer forming member 24*a* is a condition that the surface temperature of the photoreceptor drum 21 is maintained at 35° C. for three hours or more. For this reason, the image forming apparatus 100 estimates that there is a possibility that an image defect may occur due to a toner sticking to the layer forming member 24*a*.

Meanwhile, in this estimation, a period of time in which a temperature rises (two hours from the start) which is shown in FIG. 3 is not considered. When the time of the rise is considered, a condition of a double-sided printing operation may be set to be a condition that double-sided continuous printing is continuously performed for five hours or more.

In addition, hereinafter, a case where the number of printed sheets per day is assumed to be that on a day other than 2019 Jun. 4 will be described. For example, it is assumed that a day when the number of printed sheets per day is the largest is 2019 Jun. 5. The number of printed sheets per day of 2019 Jun. 5 is 20000 sheets. The number of sheets in which double-sided printing is likely to be performed on one day is 10000 sheets (20000 sheets (a maximum number of printed sheets)×50% (a double-sided ratio)). A time for which double-sided continuous printing is regarded as being performed (an alternative characteristic value) is 3.3 hours ("10000 sheets"/"3000 sheets/h") and 3.3 hours.

On the other hand, the temperature of the drum thermistor 200 on 2019 Jun. 5 is 33° C. This temperature does not satisfy a condition (35° C.) in which a toner sticks to the layer forming member 24*a*. For example, it is considered that this is because double-sided printing of 10,000 sheets is not actually performed through continuous printing and this is because there are other factors such as a low environmental temperature. For this reason, when a day when the number of printed sheets per day is the largest is assumed to be 2019 Jun. 5, the image forming apparatus 100 estimates that a possibility that an image defect caused by a toner sticking to the layer forming member 24*a* may occur is low.

In addition, it is assumed that a day when the number of printed sheets per day is the largest is 2019 Jun. 6. The temperature of the drum thermistor 200 on 2019 Jun. 6 is 37° C. This temperature satisfies a temperature condition that a toner sticks to the layer forming member 24*a*.

On the other hand, the number of printed sheets per day of 2019 Jun. 6 is 12000 sheets. The number of sheets in which double-sided printing is likely to be performed on one day is 7000 sheets (14000 sheets (a maximum number of printed sheets)×50% (a double-sided ratio)). A time for which double-sided continuous printing is regarded as being performed (an alternative characteristic value) is 2.3 hours ("7000 sheets"/"3000 sheets/h") and 3.3 hours.

Meanwhile, when the temperature of the drum thermistor 200 on 2019 Jun. 6 is 37° C., a condition that a toner sticks to the layer forming member 24*a* is a condition of two hours or more. For this reason, the temperature of the drum thermistor 200 satisfies a condition of a time for which a toner sticks to the layer forming member 24*a*. For this reason, when a day when the number of printed sheets per day is the largest is 2019 Jun. 6, the image forming apparatus 100 estimates that there is a possibility that an image defect caused by a toner sticking to the layer forming member 24*a* may occur.

Meanwhile, the temperature of the drum thermistor 200 may satisfy a temperature condition (35° C. or higher) but may not satisfy a condition of a double-sided printing operation (an alternative characteristic value). In this case, it is considered that the temperature of the drum thermistor 200 rises due to another factor different from double-sided continuous printing.

FIG. 6 is a diagram showing an example of notification data regarding estimation results of an image defect stored in the storage unit 440. The notification data shown in FIG. 6 is data including items of an abnormal temperature continuous time, the degree of urgency, and notification details.

The abnormal temperature continuous time is a time for which double-sided continuous printing is performed. The abnormal temperature continuous time is, for example, an alternative characteristic value. The abnormal temperature continuous time is classified into three time slots of equal to or greater than 0 hours and less than three hours, equal to or greater than three hours and less than five hours, and equal to or greater than five hours. The degree of urgency and the notification details are details displayed on the display 110. For example, it is assumed that an abnormal temperature continuous time (an alternative characteristic value) is less than 0 hours to less than 3 hours. In this case, there is a low possibility that a toner sticks to the layer forming member 24*a*. For this reason, there is no urgency and notification details indicating that maintenance is not necessary are notified.

It is assumed that an abnormal temperature continuous time (an alternative characteristic value) is 3.5 hours. In this case, the abnormal temperature continuous time corresponds to equal to or greater than 3 hours and less than 5 hours. For this reason, the image forming apparatus 100 selects the degree of urgency of "low" and notification details of "double-sided continuous printing is performed occasionally. Please perform maintenance regularly.". In addition, the image forming apparatus 100 displays the selected details on the display 110.

Meanwhile, the abnormal temperature continuous time of FIG. 6 is an example of a case where the surface temperature of the photoreceptor drum 21 is 35° C. When the surface temperature of the photoreceptor drum 21 is 37° C., the abnormal temperature continuous time is classified into time slots of, for example, equal to or greater than 0 hours and less than two hours, equal to or greater than two hours and less than four hours, and equal to or greater than four hours. That is, the number of pieces of notification data corresponding to the surface temperature of the photoreceptor drum 21 is stored.

Figure 7:
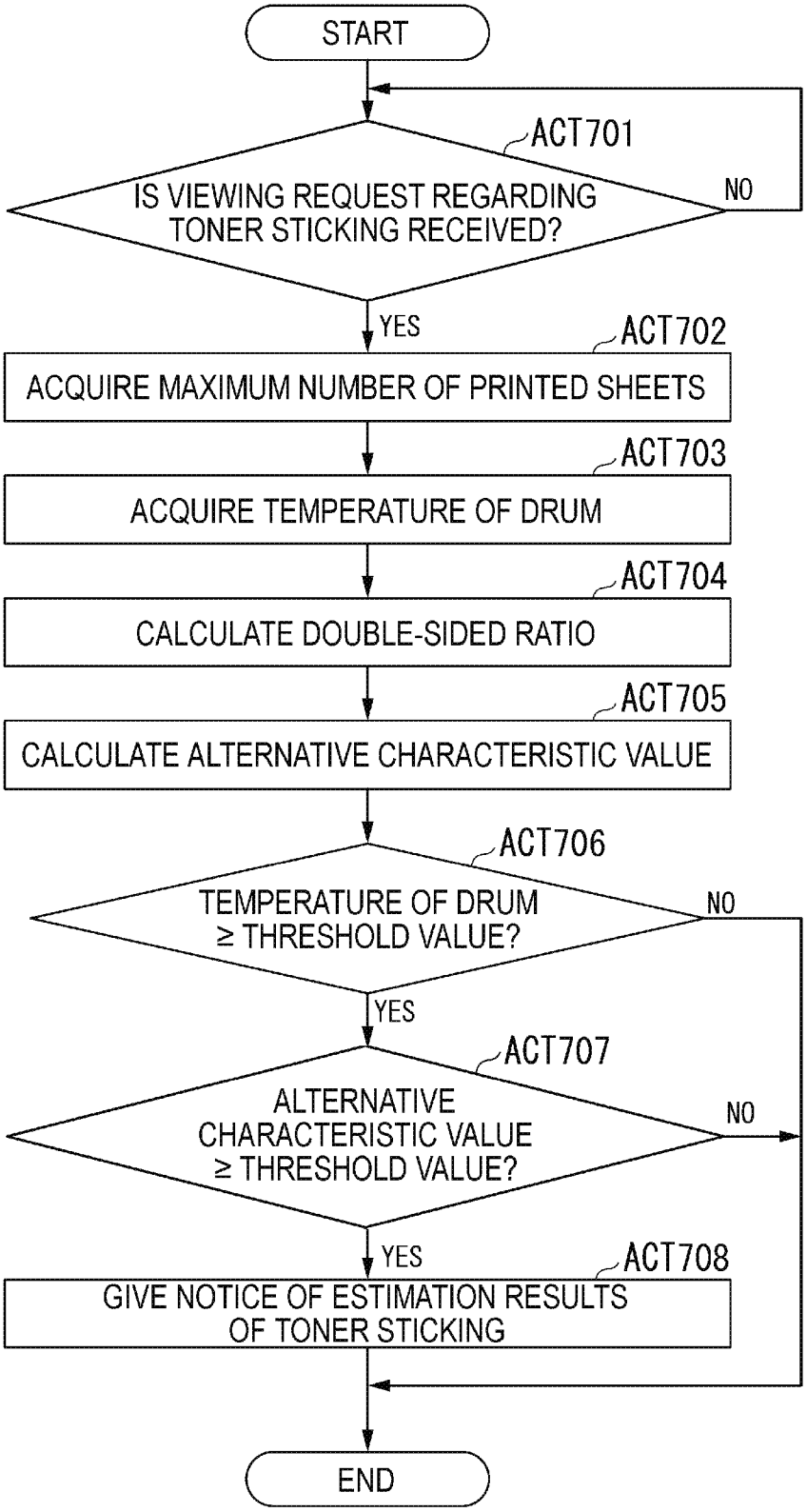
FIG. 7 is a flowchart showing an example of an image defect estimation process performed by the image forming apparatus.

FIG. 7 is a flowchart showing an example of an image defect estimation process performed by the image forming apparatus 100. As shown in FIG. 7, the image forming apparatus 100 determines whether or not a viewing request regarding toner sticking around the developing device 24 is received from an operator such as a service man (ACT701). Meanwhile, a trigger of the start in the present flowchart is not limited to the reception of the viewing request and may be set to be, for example, a specific time or may be a specific time interval.

The image forming apparatus 100 waits until the viewing request regarding toner sticking is received (ACT701: NO). When the viewing request regarding toner sticking is received (ACT701: YES), the operation history acquisition unit 412 acquires the number of printed sheets on a day when the number of printed sheets is the largest (a maximum number of printed sheets) with reference to the storage unit 440 (ACT702). In addition, the temperature history acquisition unit 411 acquires the surface temperature of the photoreceptor drum 21 (the temperature of the drum thermistor 200) on a day when a maximum number of sheets are printed (ACT703). Meanwhile, the order of the processing of ACT702 and the processing of ACT703 may be reversed.

Next, the estimation unit 420 calculates a double-sided ratio using a total number of cumulative printed sheets and the number of cumulative sheets obtained through double-sided printing (ACT704). In addition, the estimation unit 420 calculates an alternative characteristic value (ACT705). The alternative characteristic value is calculated by multiplying the maximum number of printed sheets and the double-sided ratio by each other and dividing a calculation result by a printing speed.

In addition, the estimation unit 420 determines whether or not the surface temperature of the photoreceptor drum 21 is equal to or higher than a threshold value (ACT706). When the surface temperature of the photoreceptor drum 21 is not equal to or higher than the threshold value (ACT706: NO), the estimation unit 420 terminates the process as it is. When the surface temperature of the photoreceptor drum 21 is equal to or higher than the threshold value (ACT706: YES), the estimation unit 420 determines whether or not the alternative characteristic value is equal to or higher than the threshold value (ACT707). The threshold value is a value decreasing as the surface temperature of the photoreceptor drum 21 becomes higher.

When the alternative characteristic value is not equal to or higher than the threshold value (ACT707: NO), the estimation unit 420 terminates the process as it is. When the alternative characteristic value is equal to or higher than the threshold value (ACT707: YES), the estimation unit 420 selects notification details based on the alternative characteristic value to give notice of the selected notification details (ACT708), and terminates a series of processes. Meanwhile, the order of the processing of ACT706 and the processing of ACT708 may be reversed.

Figures 8A, 8B:
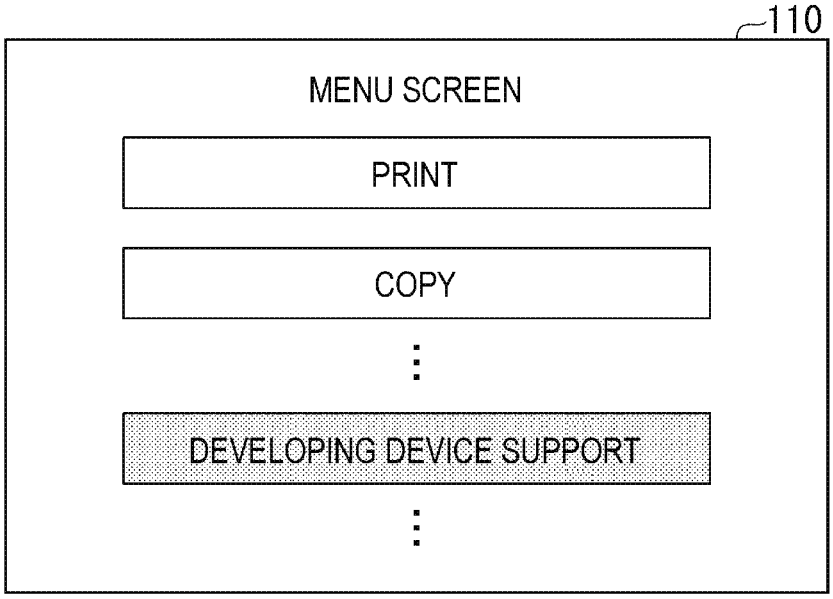
FIGS. 8A and 8B are diagrams showing an example of a screen displayed on a display.

FIGS. 8A and 8B are diagrams showing an example of a screen displayed on the display 110. FIG. 8A shows an example of a menu screen. In the menu screen, when an operator (service man) selects "developing device support", the screen transitions to a screen of FIG. 8B.

FIG. 8B shows an example of a screen showing estimation results of toner sticking. As shown in FIG. 8B, a notification indicating the degree of urgency for toner sticking and a notification for promoting the frequency and maintenance of double-sided continuous printing are displayed on the display 110.

Meanwhile, when the degree of urgency is high, these notifications may be displayed in a display mode different from that when the degree of urgency is low. The different display mode is a display mode in which the size, color, and the like of characters are conspicuous. In addition, when there are notification details, the image forming apparatus 100 may display an icon indicating that there are notification details on a menu screen or a standby screen.

Next, a modification example of the present embodiment will be described. In the following description, the points described in the above-described embodiment will be denoted by the same reference numerals and signs, and the description thereof will be omitted.

Figure 9:
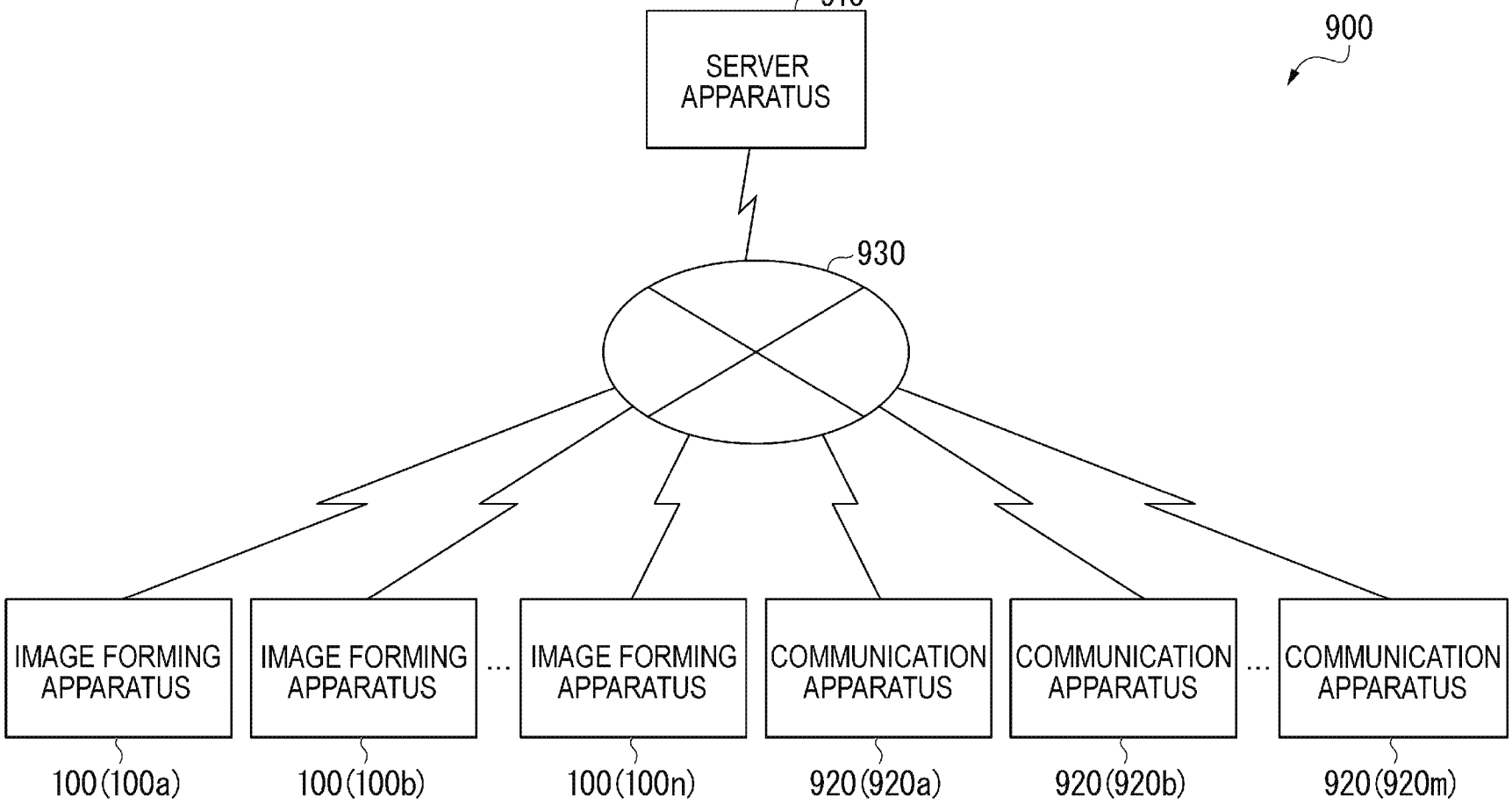
FIG. 9 is a diagram showing a system configuration example of an image forming system according to a modification example of the present embodiment.

FIG. 9 is a diagram showing a system configuration example of an image forming system 900 according to a modification example of the present embodiment. The image forming system 900 includes a plurality of image forming apparatuses 100 (100*a* to 100*n*), a server apparatus 910, and a plurality of communication apparatuses 920 (920*a* to 920*m*).

In the image forming system 900, the plurality of image forming apparatuses 100, the server apparatus 910, and the communication apparatuses 920 are connected to each other through a wired or wireless network 930. The network 930 is, for example, a local area network (LAN), a wide area network (WAN), the Internet, or the like.

The server apparatus 910 is a computer apparatus that manages a history regarding temperatures around developing devices 24 of the plurality of image forming apparatuses 100.

The communication apparatus 920 is a terminal apparatus. The communication apparatus 920 is a computer apparatus such as a smartphone, a tablet terminal, or a personal computer which is carried by a service man. The communication apparatus 920 includes a display or a speaker for giving notice of estimation results of an image defect.

Figure 10:
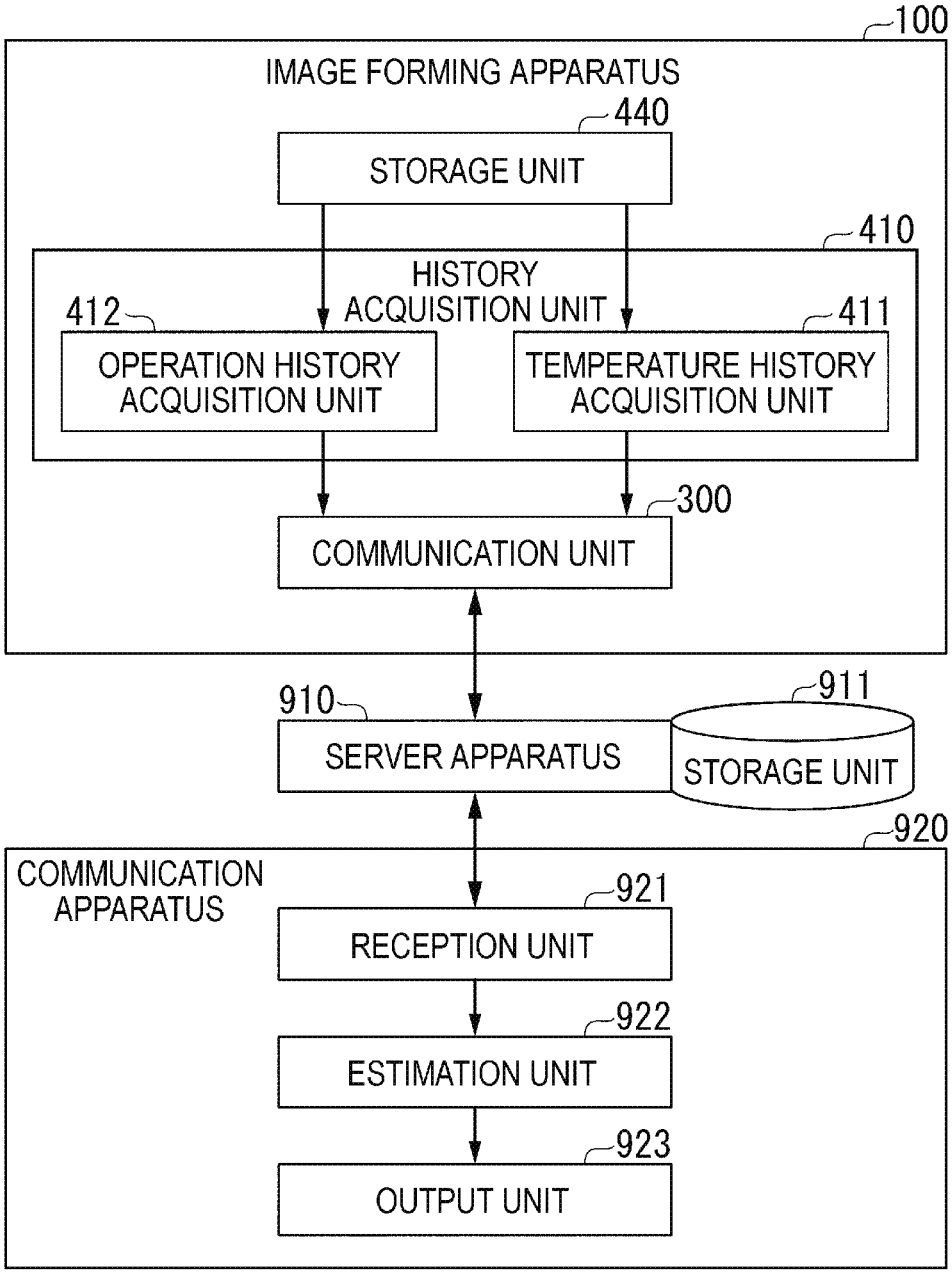
FIG. 10 is a diagram showing an example of a functional configuration of the image forming system.

FIG. 10 is a diagram showing an example of a functional configuration of the image forming system 900. The communication unit 300 transmits history data regarding a temperature around the developing device 24 to the server apparatus 910. The server apparatus 910 includes a storage unit 911. The storage unit 911 stores the history data transmitted from the communication unit 300 of the image forming apparatus 100. The storage unit 911 stores history data for each of the image forming apparatuses 100*a* to 100*n*. The history data includes the history data shown in FIG. 5.

The communication apparatus 920 includes a reception unit 921, an estimation unit 922, and an output unit 923. The reception unit 921 is an interface of a network. The reception unit 921 receives the history data transmitted from the communication unit 300 of the image forming apparatus 100 through the server apparatus 910. Meanwhile, the reception unit 921 may directly receive the history data from the image forming apparatus 100.

The estimation unit 922 is realized by a processor. The estimation unit 922 is realized by executing a program by a processor. The estimation unit 922 estimates a possibility that an image defect caused by layer formation of the layer forming member 24*a* may occur on the basis of the history data received by the reception unit 921. A method of estimating an image defect by the estimation unit 922 is the same as the estimation method of the image forming apparatus 100 described in the embodiment.

The output unit 923 outputs results of estimation performed by the estimation unit 922. The output unit 923 displays the estimation results of the estimation unit 922 on a display or outputs the estimation results as a sound from a speaker.

When the communication apparatus 920 receives a viewing request regarding toner sticking around the developing device 24 from a service man, the communication apparatus gives a request for history data to the server apparatus 910. When the server apparatus 910 receives the request for history data, the server apparatus transmits the history data to the communication apparatus 920.

Meanwhile, the server apparatus 910 may transmit only history data of the image forming apparatus 100 controlled by the service man to the serviceman (the communication apparatus 920). The storage unit 911 may store history data for each service man. Specifically, the storage unit 911 may store identification information for identifying the communication apparatus 920 carried by a service man and identification information for identifying the image forming apparatus 100 in association with each other.

Meanwhile, in the image forming system 900, the communication apparatus 920 may not include the estimation unit 922, and the server apparatus 910 may include the estimation unit 922. When the server apparatus 910 includes the estimation unit 922, the server apparatus may estimate a possibility that an image defect may occur by receiving the viewing request from the communication apparatus 920. In addition, the server apparatus 910 may transmit estimation results to the communication apparatus 920. The communication apparatus 920 may display the estimation results received from the server apparatus 910 on the display.

As described above, the image forming apparatus 100 estimates a possibility that an image defect caused by layer formation of the layer forming member 24*a* may occur on the basis of the history regarding a temperature around the developing device 24. For this reason, the image forming apparatus 100 can notify a service man whether or not use such as sticking of a toner to the layer forming member 24*a* is performed. Thereby, the service man can ascertain a user (the image forming apparatus 100) who is liable to cause an image defect before the image defect occurs. Therefore, the image forming apparatus 100 can prevent an image defect caused by a layer thickness of a toner in advance.

In addition, the estimation unit 420 estimates an image defect on the basis of a history regarding the temperature of the layer forming member 24*a* and a history regarding the operation of double-sided printing which is continuously performed. Thereby, the image forming apparatus 100 can estimate an image defect in consideration of the temperature of the layer forming member 24*a*. Thereby, the image forming apparatus 100 can improve the accuracy of estimation of the image defect.

In addition, the estimation unit 420 estimates an image defect on the basis of a history of the surface temperature of the photoreceptor drum 21 and a history regarding the operation of double-sided printing which is continuously performed. Thereby, the image forming apparatus 100 can estimate an image defect by regarding the surface temperature of the photoreceptor drum 21 as the temperature of the layer forming member 24*a*. Therefore, the image forming apparatus 100 can estimate an image defect without adding a new configuration such as a sensor that detects the temperature of the layer forming member 24*a*. For this reason, the image forming apparatus 100 can estimate an image defect with a simple configuration.

In addition, it is assumed that a history regarding the operation of double-sided printing which is continuously performed includes information of a double-sided continuous printing time. In addition, it is assumed that the estimation unit 420 estimates an image defect on the basis of a history regarding the temperature of the layer forming member 24*a* and information of a double-sided continuous printing time. Thereby, the image forming apparatus 100 can estimate an image defect in consideration of the double-sided continuous printing time. Therefore, the image forming apparatus 100 can improve the accuracy of estimation of the image defect.

Further, in the present embodiment, a double-sided continuous printing time is an alternative characteristic value. Specifically, the alternative characteristic value is a calculated value which is calculated on the basis of a value indicating the degree of double-sided printing (a double-sided ratio) and a total number of printed sheets (a maximum number of printed sheets) per day. Thereby, the image forming apparatus 100 can estimate an image defect without adding a new configuration such as a storage apparatus that stores a job history. Therefore, the image forming apparatus 100 can estimate the image defect with a simple configuration.

In addition, the estimation unit 420 estimates a possibility that an image defect may occur when the surface temperature of the photoreceptor drum 21 is equal to or higher than a predetermined temperature and an alternative characteristic value is equal to or higher than a threshold value. Specifically, the estimation unit 420 estimates a possibility that an image defect may occur when both a "temperature condition" and a "condition of a double-sided printing operation" are satisfied. Thereby, the estimation unit 420 can estimate that there is no possibility that an image defect may occur when any one of both the conditions is not satisfied. Therefore, the image forming apparatus 100 can improve the accuracy of estimation at the time of estimating a possibility that an image defect may occur.

Further, in the present embodiment, a threshold value used for the estimation of the estimation unit 420 is a value varying depending on the surface temperature of the photoreceptor drum 21. For this reason, the estimation unit 420 can estimate an image defect using a threshold value based on the surface temperature of the photoreceptor drum 21. Therefore, the image forming apparatus 100 can estimate the image defect with higher accuracy.

In addition, the storage unit 440 may store a job history of printing whenever printing is performed. In addition, information of a double-sided continuous printing time may be acquired from the job history. Thereby, the image forming apparatus 100 can acquire information of a time of double-sided continuous printing which is actually performed. Therefore, it is possible to improve the accuracy of estimation of an image defect.

The output unit 430 includes a display unit (the display 110) that displays estimation results of an image defect. Thereby, the image forming apparatus 100 can notify a service man or a user of the estimation results with high accuracy. In addition, the display 110 displays the estimation results in a display mode based on a possibility that an image defect may occur. For this reason, the image forming apparatus 100 can more effectively give notice of the estimation results.

Further, in the image forming system 900 of the modification example, the communication apparatus 920 estimates a possibility that an image defect caused by layer formation may occur on the basis of a history regarding a temperature around the developing device 24. For this reason, the communication apparatus 920 can notify a service man of estimation results. Therefore, the service man can ascertain the estimation results without going to a place where the image forming apparatus 100 is installed. Thereby, the image forming system 900 can prevent an image defect caused by a layer thickness of a toner in advance for each of the plurality of image forming apparatuses 100.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. An image forming apparatus, comprising:

an image carrier;

an exposing device which exposes the image carrier to form an electrostatic latent image on the image carrier;

a developing device which comprises a layer forming member to form a toner layer on a developing roller and form a toner image by developing the electrostatic latent image;

a transfer device which transfers the toner image formed by the developing device to a sheet;

a fixing device which fixes the toner image by heating the toner image on the sheet;

a history acquisition component which acquires a history regarding a temperature of the layer forming member;

an estimation component which estimates a possibility that an image defect caused by the toner layer formation occurs on a basis of the history regarding the temperature which is acquired by the history acquisition component; and an output component which outputs estimation results of the estimation performed by the estimation component, wherein the output component outputs the estimation results to a display component that displays an image.

2. The apparatus according to claim 1, wherein the history acquisition component further comprises an operation history acquisition component which acquires a history regarding an operation of double-sided printing, and the estimation component performs the estimation on a basis of the history regarding the temperature of the layer forming member and the history regarding the operation.

3. The apparatus according to claim 2, wherein the history regarding the temperature of the layer forming member comprises information of a surface temperature of the image carrier, and the estimation component performs the estimation on a basis of the information of the surface temperature and the history regarding the operation.

4. The apparatus according to claim 2, wherein the history regarding the operation comprises information of a time for which double-sided printing is continuously performed, and the estimation component performs the estimation on a basis of the history regarding the temperature of the layer forming member and the information of the time.

5. The apparatus according to claim 4, wherein the information of the time is a calculated value which is calculated on a basis of a value indicating a degree to which double-sided printing is performed within a predetermined period, a total number of printed sheets obtained in a period different from the predetermined period and a printing speed.

6. The apparatus according to claim 5, wherein the history regarding the temperature of the layer forming member comprises information of a surface temperature of the image carrier, and the estimation component estimates the possibility that an image defect occurs when the surface temperature is equal to or higher than a predetermined temperature and the calculated value is equal to or greater than a threshold value.

7. The apparatus according to claim 6, wherein the threshold value is a value varying depending on the surface temperature.

8. The apparatus according to claim 4, further comprising:

a storage component which stores a job history of printing whenever printing is performed, wherein the information of the time is acquired from the job history of printing which is stored in the storage component.

9. The apparatus according to claim 1, wherein the display component is a liquid crystal display with a touch panel.

10. A system, comprising:

an image forming apparatus comprising:

an image carrier, an exposing device which exposes the image carrier to form an electrostatic latent image on the image carrier, a developing device which comprises a layer forming member to form a toner layer on a developing roller and form a toner image by developing the electrostatic latent image, a transfer device which transfers the toner image formed by the developing device to a sheet, a fixing device which fixes the toner image on the sheet, a history acquisition component which acquires a history regarding a temperature of the layer forming member, and a communication component which transmits the history acquired by the history acquisition component; and a communication apparatus which is connected to the image forming apparatus, the communication apparatus comprising:

a reception component which receives the history transmitted from the image forming apparatus directly from the image forming apparatus or through another apparatus, an estimation component which estimates a possibility that an image defect caused by the toner layer formation occurs on a basis of the history received by the reception component, and an output component which outputs results of the estimation performed by the estimation component, wherein the output component outputs the estimation results to a display component that displays an image.

11. The system according to claim 10, wherein the history acquisition component further comprises an operation history acquisition component which acquires a history regarding an operation of double-sided printing, and the estimation component performs the estimation on a basis of the history regarding the temperature of the layer forming member and the history regarding the operation.

12. The system according to claim 11, wherein the history regarding the temperature of the layer forming member comprises information of a surface temperature of the image carrier, and the estimation component performs the estimation on a basis of the information of the surface temperature and the history regarding the operation.

13. The system according to claim 11, wherein the history regarding the operation comprises information of a time for which double-sided printing is continuously performed, and the estimation component performs the estimation on a basis of the history regarding the temperature of the layer forming member and the information of the time.

14. The system according to claim 13, wherein the information of the time is a calculated value which is calculated on a basis of a value indicating a degree to which double-sided printing is performed within a predetermined period, a total number of printed sheets obtained in a period different from the predetermined period and a printing speed.

15. The system according to claim 14, wherein the history regarding the temperature of the layer forming member comprises information of a surface temperature of the image carrier, and the estimation component estimates the possibility that an image defect occurs when the surface temperature is equal to or higher than a predetermined temperature and the calculated value is equal to or greater than a threshold value.

16. The system according to claim 15, wherein the threshold value is a value varying depending on the surface temperature.

17. The system according to claim 13, further comprising:

a storage component which stores a job history of printing whenever printing is performed, wherein the information of the time is acquired from the job history of printing which is stored in the storage component.

18. The system according to claim 10, wherein the display component is a liquid crystal display with a touch panel.

19. A method for an image forming apparatus, comprising:

exposing an image carrier to form an electrostatic latent image on the image carrier;

forming a toner layer on a developing roller and forming a toner image by developing the electrostatic latent image;

transferring the toner image to a sheet;

fixing the toner image by heating the toner image on the sheet;

acquiring a history regarding a temperature of the layer forming member;

estimating a possibility that an image defect caused by forming the toner layer occurs on a basis of the history regarding the temperature; and outputting estimation results of the estimation to a display component that displays an image.

20. The method according to claim 19, further comprising:

acquiring a history regarding an operation of double-sided printing; and estimating a possibility that an image defect caused by forming the toner layer occurs on a basis of the history regarding the temperature of the layer forming member and the history regarding the operation.

* * * * *